United States Patent [19]

Erlandsson

[11] 4,453,476

[45] Jun. 12, 1984

[54] LIQUID WASTE FEEDING SYSTEM FOR AN INCINERATOR

[75] Inventor: Kjell I. Erlandsson, Milwaukee, Wis.

[73] Assignee: Kelley Company, Inc., Milwaukee, Wis.

[21] Appl. No.: 407,955

[22] Filed: Aug. 13, 1982

Related U.S. Application Data

[62] Division of Ser. No. 258,993, Apr. 30, 1981, Pat. No. 4,372,226.

[51] Int. Cl.[3] ..... F23G 7/06

[52] U.S. Cl. ..... 110/346; 110/212; 110/238; 110/187; 431/76

[58] Field of Search ..... 110/235, 238, 262, 187, 110/190, 345, 346; 431/76

[56] References Cited

U.S. PATENT DOCUMENTS

| | | | |
|---|---|---|---|
| 2,441,025 | 5/1948 | Logan | 431/76 |
| 3,369,749 | 2/1968 | Siegmund et al. | 431/76 |
| 3,611,954 | 10/1971 | Monroe, Jr. | 110/238 |
| 3,704,676 | 12/1972 | Davies et al. | 110/238 |
| 3,727,564 | 4/1973 | Anderson et al. | 110/212 |
| 3,780,674 | 12/1973 | Liu | 110/238 |
| 3,807,321 | 4/1974 | Stockman | 110/212 |
| 3,861,334 | 1/1975 | Stockman | 110/187 |
| 3,903,813 | 9/1975 | Pau | 110/238 |
| 3,954,381 | 5/1976 | Monecaux | 110/190 |
| 3,975,228 | 8/1976 | Yasunaga et al. | 110/238 |
| 4,038,032 | 7/1977 | Brewer et al. | 110/212 |
| 4,206,711 | 6/1980 | Konard | 110/238 |
| 4,279,208 | 7/1981 | Guillaume et al. | 831/76 |
| 4,316,420 | 2/1982 | Kochey | 110/187 |
| 4,378,334 | 3/1983 | Alguire et al. | 110/345 |

FOREIGN PATENT DOCUMENTS

| | | | |
|---|---|---|---|
| 22228 | 4/1981 | European Pat. Off. | 110/238 |
| 1526105 | 6/1969 | Fed. Rep. of Germany | 110/238 |
| 53-4376 | 1/1978 | Japan | 110/238 |

OTHER PUBLICATIONS

Consumat Liquid Waste and Sludge Accessory Systems.
Trane Thermal Waste Disposal & Recovery Systems.
Trane Liquid Waste Disposal System.
Liqui-Datur Waste Liquid Incinerators.
Prenco Pyro-Decomposition System.
Kelley Company, Inc., drawings 159-139, 159-113.

*Primary Examiner*—Henry C. Yuen
*Attorney, Agent, or Firm*—Andrus, Sceales, Starke & Sawall

[57] ABSTRACT

A liquid waste feeding system to be used in conjunction with a solid waste, pyrolytic incinerator. The liquid waste is atomized and injected into the upper end portion of the pyrolysis chamber of the incinerator through a retractable nozzle assembly. The nozzle assembly is automatically extended into the pyrolysis chamber during periods when the liquid waste is to be supplied to the incinerator, and is retracted to a location outside of the chamber when liquid waste is not being supplied. The feed rate of the liquid is controlled by the incinerator stack temperature and modulates between two temperature set points. At the upper set point, the feed rate decreases on temperature rise, which will occur when burning liquids with high BTU values. At the lower set point the feed rate decreases on temperature drop, to insure that minimum combustion temperatures are maintained in order to achieve complete burnout in the incinerator thermal reactor.

8 Claims 10 Drawing Figures

COMPRESSED AIR
LIQUID FROM TRANSFER PUMP
STORAGE TANK
STRAINER
VAC. SWITCH
PUMP
M
PRESSURE SWITCH

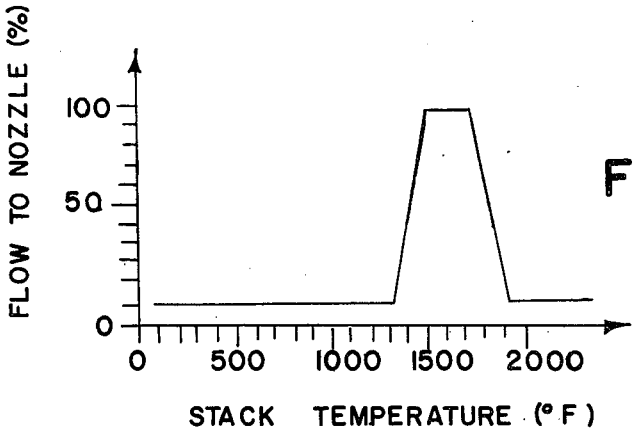
FIG. 7
FIG. 8
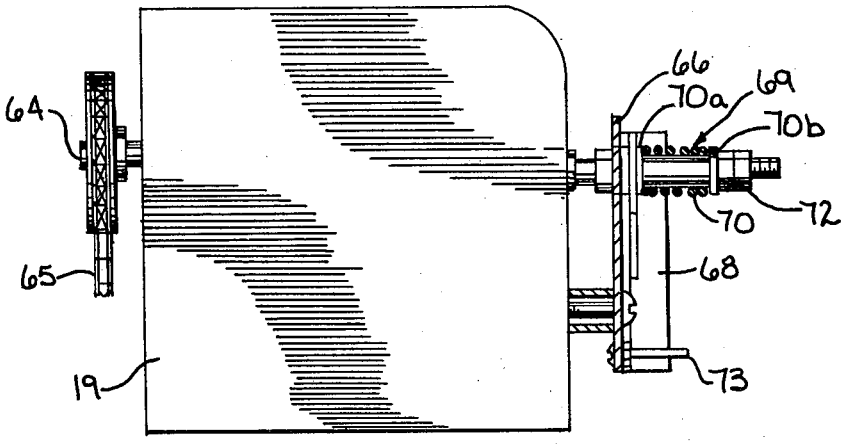
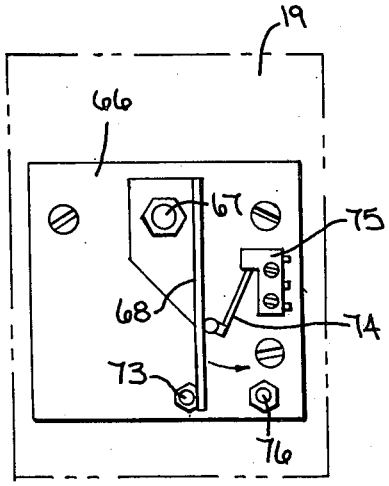
FIG. 9

LIQUID WASTE FEEDING SYSTEM FOR AN INCINERATOR

This is a division of application Ser. No. 258,993, filed Apr. 30, 1981 now U.S. Pat. No. 4,372,226.

BACKGROUND OF THE INVENTION

Pyrolytic incineration operates on a starved air principle, and air supplied to the pyrolysis chamber generally constitutes less than half of the stoichiometric air requirement for combustion of the waste. The low air supply rate achieves partial combustion and vaporization of the waste, and results in low gas velocity and turbulence in the pyrolysis chamber which minimizes mechanical entrapment of particulate matter in the waste gases.

The waste gases from the pyrolysis chamber, then pass into the thermal reactor section of the incinerator which is located in the stack. Atmospheric air is drawn into the thermal reactor section to achieve substantially complete combustion of the combustible waste gases in a second zone of combustion.

The normal incinerator is designed for peak thermal capacities, and the peak capacity is rarely attained except when waste material is being charged into the combustion chamber. Consequently, the incinerator is normally operating well below peak capacity.

Certain liquid wastes, such as solvents, paint, lacquer, and the like, have a high BTU content, while other water base liquid wastes have a relatively low BTU content. In addition, the viscosity and solids content of the liquid waste can vary considerably.

In the past, incinerators have been designed to separately burn either solid or liquid waste materials and in some cases, incinerators have been designed with sequential combustion chambers to handle both liquid and solid waste. However, none of the incinerators, as used in the past to handle both solid and liquid waste materials have been programmed to utilize the spare, below-peak capacity of the solid waste incinerator.

SUMMARY OF THE INVENTION

The invention is directed to a liquid waste feeding system to be used with a solid waste pyrolytic incinerator. In accordance with the invention, the feed rate of the liquid waste is controlled by the stack temperature of the incinerator and consequently, the system utilizes the spare, below-peak capacity of the solid waste incinerator.

More specifically, the liquid waste is atomized and is sprayed into the upper end portion of the pyrolysis chamber through a retractable nozzle assembly. The nozzle assembly is automatically extended into the chamber at periods when liquid waste is to be supplied, and the nozzle assembly is retracted during periods when liquid waste is not being supplied.

The liquid waste is contained within a storage tank and is delivered through a supply line to the nozzle assembly by a fixed displacement pump. The flow of liquid within the supply line is controlled by a modulating valve, the operation of which is responsive to the stack temperature and modulates between two temperature set points. As the upper set point, the liquid waste feed rate decreases on a temperature rise, as occurs when burning liquids with high BTU values, and the lower set point comes into action when feeding waste liquids with low BTU values which drive the stack temperature down. Thus, the modulating control is responsive to the stack temperature and automatically controls the flow of liquid waste to the nozzle assembly to maintain the stack temperature within upper and lower set points. As the system is operated through the stack temperature, it will operate effectively regardless of the characteristics of the liquid waste, such as BTU value, viscosity, solids content, and the like.

With the feed system of the invention, the spare, below-peak capacity of the solid waste incinerator can be utilized for combusting the liquid waste, which eliminates the need for a separate incinerator for the liquid waste. By combustion of the liquid waste, the cost of disposal is substantially reduced over systems which require that the liquid waste be hauled to disposal sites.

With the control system as used in the invention, the increase of the liquid feed rate to the pyrolysis chamber is relatively slow, in that the feed rate increases from 0% to 100% flow in a period of up to approximately 60 minutes. This relatively slow feed rate increase eliminates the risk of the stack temperature overshooting the set point due to the time lags in the combustion system. On the other hand, the decrease of liquid feed rate is relatively fast, with the feed rate decreasing from 100% to 0% flow in a period of about 50 seconds. This relatively fast decrease enables the system to react quickly if there is a combustion surge from solid waste that is introduced into the pyrolysis chamber.

As the nozzle assembly is retractable to a position outside of the pyrolysis chamber, the nozzle is protected from the heat of combustion during periods when the liquid waste is not being introduced to the combustion chamber. Retracting the nozzle assembly also prevents any residual waste liquid on the end of the nozzle assembly from carbonizing at high temperatures and thereby minimizes the possibility of clogging the nozzle.

The invention also includes a provision for automatically closing off the opening in the pyrolysis chamber as the nozzle assembly is withdrawn from the chamber. By closing the opening, the nozzle assembly is not only protected from the heat within the pyrolysis chamber, but the closure prevents air from being drawn into the chamber which could alter the air balance.

In the control system, the pump which delivers the liquid waste to the nozzle assembly is interlocked with the temperature of the pyrolysis chamber, thereby insuring that there is a certain minimum temperature in the pyrolysis chamber for a safe light-off of the liquid waste. Similarly, the pump is interlocked with the charge door of the solid waste feeder on the incinerator, so that no liquid will flow during the feed cycles of the solid waste material.

The control system also includes a time delay that is interconnected with the drive for retracting the nozzle assembly, so that when the pump shuts down, the nozzle assembly will remain extended in the pyrolysis chamber for a short period of time in order to permit the liquid waste to drain from the nozzle assembly into the chamber, rather than on the outside of the incinerator.

The nozzle assembly is also equipped with a limit switch which prevents the liquid waste supply pump and the atomizing air from being activated until the nozzle assembly is fully extended into the pyrolytic chamber. This again insures that liquid will not be supplied to the nozzle assembly until the nozzle assembly is fully extended into the pyrolytic chamber.

Other objects and advantages will appear in the course of the following description.

DESCRIPTION OF THE DRAWINGS

The drawings illustrate the best mode presently contemplated of carrying out the invention.

In the drawings:

FIG. 7 is a graph plotting the flow of liquid waste material against the stack temperature;

FIG. 8 is a side elevation of the modulating valve control unit;

FIG. 9 is an end view of the control unit shown in FIG. 8; and

DESCRIPTION OF THE ILLUSTRATED EMBODIMENT

Figure 1:
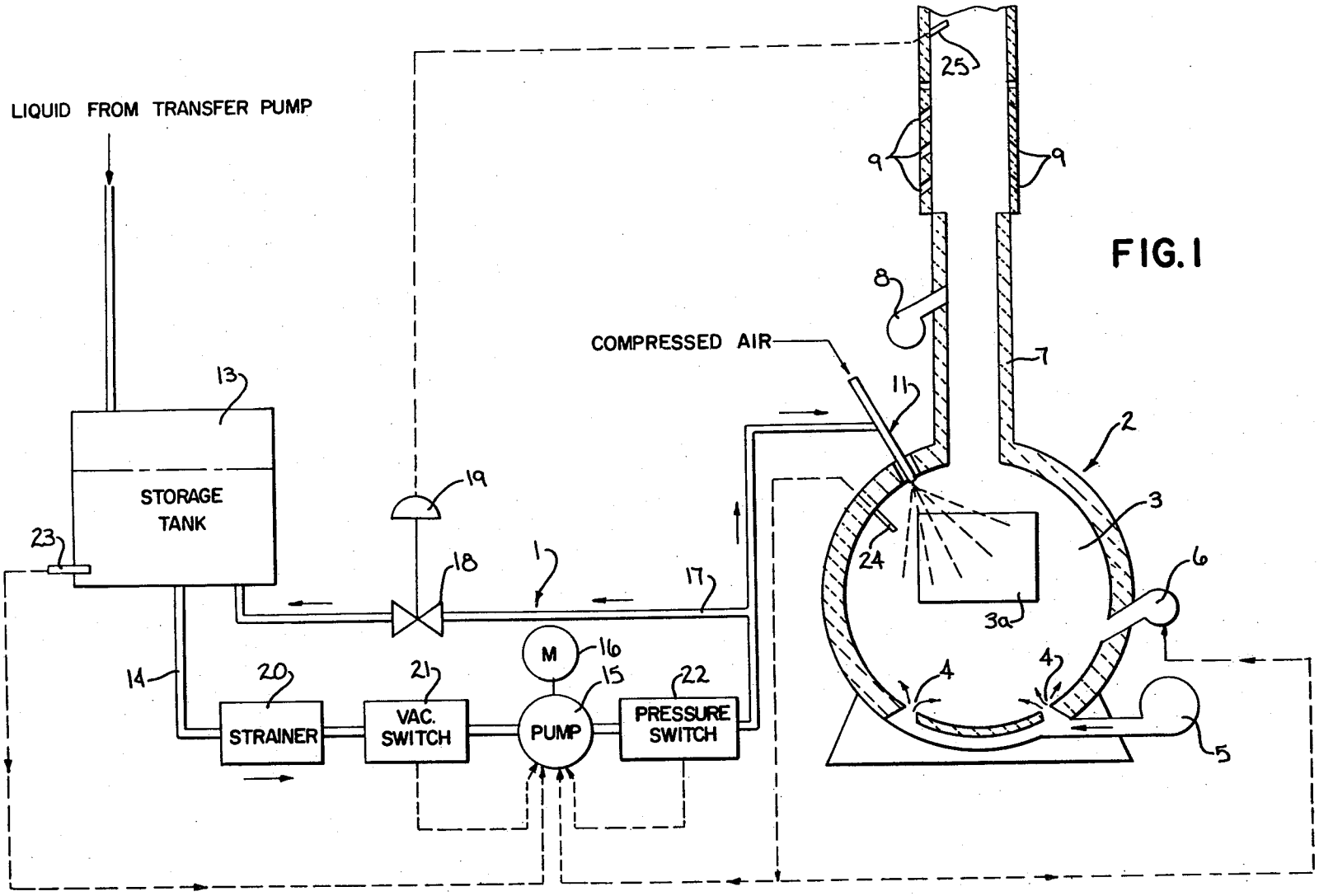
FIG. 1 is a schematic drawing showing the liquid feed system of the invention as incorporated with a pyrolytic incinerator.

FIG. 1 is a schematic drawing showing the liquid feed system 1 of the invention incorporated with a conventional pyrolytic incinerator 2.

The incinerator 2 is generally cylindrical in shape and defines a pyrolysis chamber 3. Solid waste material is adapted to be introduced into the chamber 3 through a feed or charging opening 3*a* in an end wall of the incinerator, and air is supplied to the lower end of the chamber through air supply lines 4 which are connected to the outlet of a blower 5.

A conventional burner 6 is mounted in the wall of the incinerator, and auxiliary fuel, such as gas or oil, can be supplied to the burner to initially ignite the solid waste. After the waste is ignited, operation of the burner is normally terminated, for the heat generated by the combustion of the waste material will be sufficient to maintain the pyrolytic process. The air supplied to the pyrolysis chamber 3 through the supply line 4 is generally less than the stoichiometric air requirements for combustion of the waste. This results in only partial combustion of the waste and pyrolytic gasification. The waste gases are discharged from the pyrolysis chamber 3 through a stack 7, and a burner 8 is mounted in the thermal reactor section of the stack. The burner 8 acts as a pilot flame and ignites the combustion waste gases. Air from the atmosphere is drawn into the stack 7 through a series of openings 9 to provide complete combustion of the combustible gases.

The construction of the pyrolytic incinerator and the thermal reactor is in itself conventional and forms no part of the present invention.

In accordance with the invention, a nozzle assembly 11 is mounted for movement within a pipe 12 in the upper portion of the incinerator 2 between a retracted position, in which the nozzle assembly is located outside of the pyrolysis chamber 3, and an extended position where the inner end of the nozzle assembly is located within the chamber. Atomized liquid waste is adapted to be sprayed into the chamber 3 through the nozzle assembly 11 when it is in its extended position.

As illustrated in FIG. 1, the liquid waste material is stored in a tank 13. The liquid waste can take the form of waste having a relatively high BTU value, such as solvents, paint, lacquer, and the like, or the waste can have a relatively low BTU value, and take the form of water-based liquids.

The liquid waste is delivered through a supply line 14 from tank 13 to nozzle assembly 11 by a fixed displacement pump 15 driven by motor 16. The pump is preferably a progressing cavity type utilizing a screw or auger-type rotor in an elastomeric stator. Pumps of the type are capable of handling liquids containing substantial quantities of solid particles.

As shown in FIG. 1, a return line 17 is connected between the line 14, downstream of pump 15, and the storage tank 13 and a modulating valve 18, which is driven by motor 19, is connected in the return line. Operation of the modulating valve 18, as will be more fully described hereinafter, serves to control the flow of liquid waste through the supply line 14 to the nozzle assembly 11.

A conventional strainer 20 is mounted in the supply line 14 upstream of the pump to remove foreign materials, and a vacuum switch 21 is mounted between strainer 20 and the pump 15, while a pressure switch 22 is mounted on the downstream side of the pump. The vacuum switch 21 senses the vacuum on the suction side of the pump and is operable to shut off the pump if the vacuum exceeds a pre-set value which indicates clogging of the strainer. Similarly, the pressure switch 22 is operable to shut off operation of the pump, if the pressure on the discharge side of the pump exceeds a pre-set value, indicating clogging of the nozzle assembly 11.

The supply system also includes a liquid level sensor 23 which is mounted in the lower end of the storage tank 13, a temperature sensor 24 located within the pyrolysis chamber, and a second temperature sensor 25 which is mounted in the stack 7. The function of the sensors 23–25 will be described hereinafter.

Figure 2:
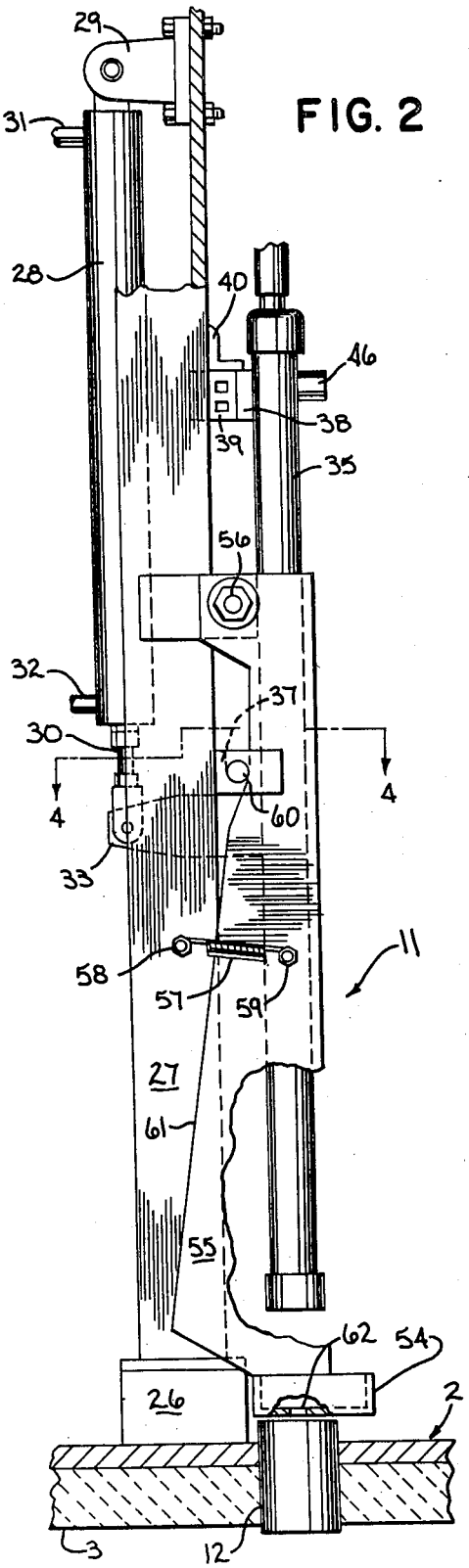
FIG. 2 is a side elevation of the nozzle assembly in the retracted position.

The nozzle assembly is best shown in FIGS. 2–5 and includes a base 26 which is mounted on the outer surface of the incinerator 2 and angles 27 extend outwardly from base 26. As shown in FIG. 2, the upper end of a pneumatic cylinder 28 is pivotally connected to lugs 29 on the upper portions of angles 27, and a piston rod 30 extends from the lower end of cylinder 28. Air is supplied to the opposite ends of the cylinder 28 through air lines 31 and 32 respectively.

The lower end of the piston rod 30 is connected to a slide plate 33 which extends through a longitudinal slot 34 between angles 27, and the outer end of the slide plate is secured to the outer surface of nozzle tube 35. Extension and retraction of the piston rod 30 will move the nozzle tube 35 relative to the angles 27 to project the nozzle tube into the pyrolysis chamber 3 and to retract it to a location located outside of the chamber.

To guide the nozzle tube 35 in sliding movement, a pair of angles 36 are mounted on opposite sides of the slide plate 33 and the flanges of the angles 36 ride against the surface of the angles 27. In addition, an upper angle 37 is mounted across the upper edges of the slide plate 33 and angles 36.

An upper guide structure is also utilized to guide the nozzle tube 35 in sliding movement, and the upper guide structure includes a guide plate 38, which projects through slot 34 in angles 27, and a pair of angles 39, similar to angles 36, are secured to opposite sides of the guide plate 38. In addition, an upper angle 40, similar to angle 37, is secured to the upper edges of the guide plate 38 and angles 39. With this guide construction, the nozzle tube 35 is guided for sliding movement relative to the fixed angles 27.

Figure 5:
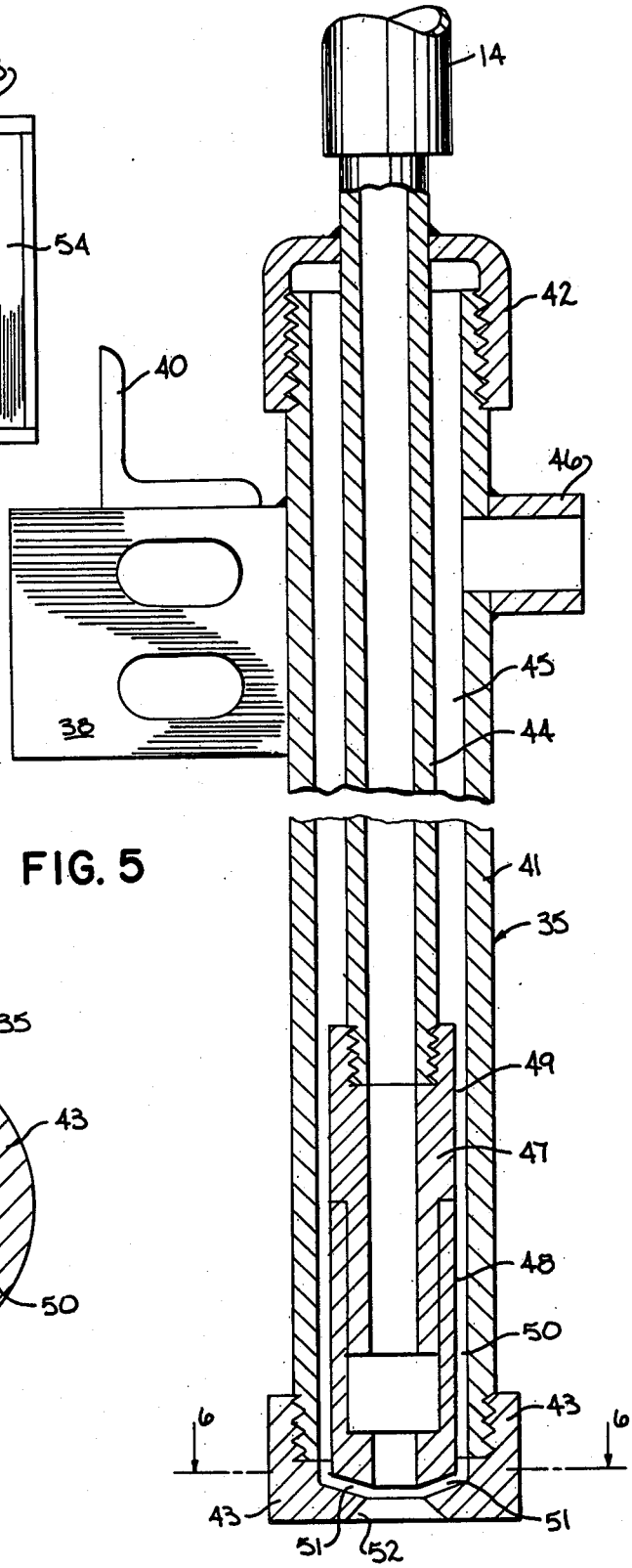
FIG. 5 is a side elevation of the nozzle tube with parts broken away.
Figure 6:
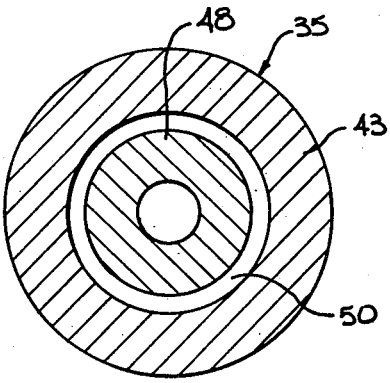
FIG. 6 is a section taken along line 6—6 of FIG. 5.

The construction of the nozzle tubes is best illustrated in FIGS. 5 and 6. The nozzle tube 35 includes an outer tube 41, and the outer end of the tube 41 is enclosed by a threaded cap 42, while a nozzle 43 is threaded on the inner end of tube 41. Mounted concentrically within the tube 41 is tube 44 and the space between tubes 41 and 44 defines an annular passage 45. Air under pressure is supplied to the annular passage 45 through an air inlet conduit 46 which is mounted in the outer end of the tube 41.

The inner end of the tube 44 is threaded to an adapter 47, which is disposed in the inner end of tube 41, and the inner end of the adapter 47 is fitted within the inner end 48 of nozzle 43. Both the adapter 47 and the inner tubular end 48 of nozzle 43 are spaced radially inward of tube 41 to provide annular passages 49 and 50, respectively, that communicate with annular passage 45. The outer end portion of nozzle 43 is provided with a series of holes or passages 51 that connects with passage 50. Thus, the air introduced into annular passage 45 passes through passages 49, 50 and 51 and is discharged via holes 51 into the central conical opening 52 of nozzle 43.

The liquid waste is introduced into the central tube 44. In this regard, the outer end of tube 44 is secured within an opening in cap 42 and projects outwardly beyond the cap and is engaged with the liquid supply line 14. Thus, the waste liquid is conducted into the inner tube 44 for delivery through the nozzle 43, while the air is introduced through the annular passage 45 and is discharged generally radially into contact with the liquid flow stream to atomize the liquid.

As previously noted, the nozzle tube 35 is adapted to be extended into the pyrolysis chamber 3 during periods when liquid waste is to be supplied to the chamber, and the nozzle tube is adapted to be retracted to a location outside of the pyrolysis chamber when no liquid waste is being supplied. As a feature of the invention, the opening 12 in the chamber 3 is closed off when the nozzle tube is in the storage or inoperative position. In this regard, a cup-shaped cover 54 is mounted on the inner end of a channel-shaped support 55 that is pivotally connected to channel 27 at pivot 56. The cover 54 is biased to a closed position, in which it is located in alignment with pipe 12, by a spring 57 which is connected between a pin 58 mounted on angle 27 and a pin 59 secured to the support 55. The spring urges the cover to the closed position, as shown in FIG. 2.

Figure 3:
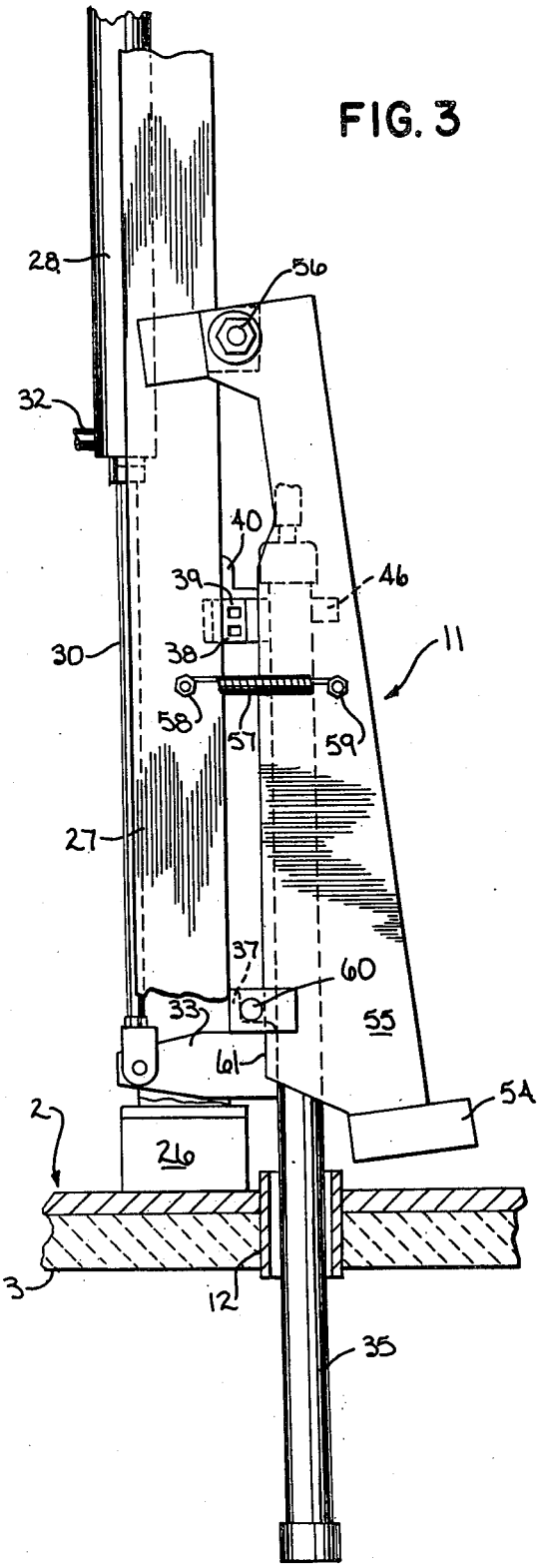
FIG. 3 is a view similar to FIG. 3 showing the nozzle assembly in the extended position.
Figure 4:
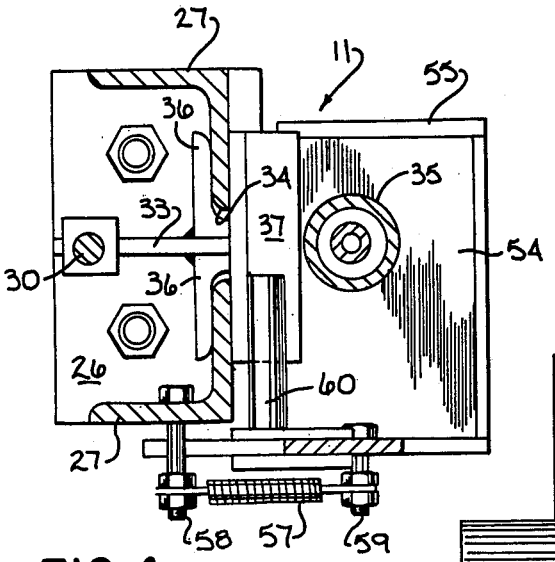
FIG. 4 is a section taken along line 4—4 of FIG. 2.

The cover 54 is automatically moved to an open position as the nozzle tube 35 is extended into the pyrolysis chamber 3 by action of a follower pin 60 that is mounted on the movable guide structure of the nozzle tube and rides against a cam surface 61 on support 55. As the nozzle tube 35 moves inwardly, the follower 60 will ride against cam surface 61 to pivot the cover 54 and support 55 about the pivot 56, as shown in FIG. 3, thereby opening the pipe 12 and enabling the nozzle tube 35 to be extended into the chamber 3. As the nozzle tube 35 is retracted from the chamber, the spring 57 will automatically return the cover 54 to the closed position.

A drain hole 62 is provided in cover 54 to drain any residual liquid which may drip from the nozzle and tend to accumulate in the cover.

As the nozzle tube 35 is retractable outside of the pyrolysis chamber during periods when liquid waste is not being supplied, the nozzle tube is not subjected to the intense heat of combustion during these periods. Moreover, carbonization of residual liquid waste at the end of the nozzle, which can occur if the residual liquid is subjected to elevated temperatures for prolonged periods, will be minimized. As a further benefit, the cover 54, which automatically closes the conduit 12 when the nozzle tube is extended into the pyrolysis chamber, minimizes the entry of air into the chamber, thus maintaining the desired air balance in the chamber.

The modulating control for the valve 18 is best shown in FIGS. 8 and 9. As illustrated, the motor 19 has an output shaft 64 which is connected to the valve 18 through a sprocket and chain drive, indicated generally by 65, so that rotation of the drive shaft 64 will act to rotate the valve stem and move the valve in a conventional manner between open and closed positions. A generally rectangular plate 66 is mounted in spaced relation on the opposite side of the motor from shaft 64, and a control shaft 67, which is connected to drive shaft 64, and rotates therewith, extends through an opening in the plate 66 and carries an arm 68. As shown in FIG. 8, the arm 68 is connected to the shaft 67 through a spring clutch assembly 69 which includes a coil spring 70 that is interposed between spring seats 70A and 70B. The seat 70A is disposed in engagement with the outer surface of arm 68, while the outer seat 70B is retained in position on the shaft 67 by means of nuts 72. The force of the spring 70 urges the arm 68 into engagement with a nut on the shaft 67, so that under normal conditions the arm 68 will rotate in accordance with the rotation of the control shaft 67.

When the modulating valve 18 is in the open condition, the liquid waste will be pumped through return line 17 to tank 13 and there will be no flow of liquid waste to the nozzle assembly 11. Under these no flow conditions, the arm 68 is engaged with stop 73 on plate 66. When the system calls for liquid waste to be supplied to the pyrolysis chamber, the motor 19 will rotate the shafts 65 and 67 in the direction of the arrow in FIG. 9. Rotation of shaft 65 will move the valve 18 toward the closed position to increase the flow of liquid waste to the nozzle assembly, while corresponding rotation of shaft 67 will move arm 68 away from stop 73 to pivot arm 74 of limit switch 75, thereby actuating the limit switch. The function of the limit switch 75 is to activate an "on-off" timer, which will operate the modulating valve motor 19 in an incremental manner to provide a relatively slow movement of the valve to the closed or full flow condition.

After actuation of limit switch 75, continued rotation of the shaft 67 will bring the arm 68 into contact with the stop 76 and as further rotation of the arm is thus limited, the spring clutch assembly 69 will permit the shaft 67 to rotate relative to the arm 68. In practice, the shaft 67 will rotate through about 120° from its full open position against stop 73 to the full closed position wherein 100% of the liquid waste is being supplied to the nozzle assembly 11. Normally, it takes approximately 50 seconds for the shaft 67 to move through the 120°, but the incremental movement as controlled by the "on-off" timer can extend this up to 60 minutes and, as previously noted, the clutch assembly 60 will slip to permit the shaft 67 to rotate while the arm is engaged with the stop 76.

When the system calls for a decrease in the supply of liquid waste to the nozzle assembly 11, the shaft 67 is rotated in the opposite direction to open the valve and reduce the flow to the nozzle assembly. As the shaft is rotated (clockwise in FIG. 9), the arm 68 moves off of the limit switch arm 74 to open the limit switch 75 and deactivate the "on-off" timer. Thus, the motor shaft 64 will return to the full open position in a continuous manner, rather than in an incremental manner, which gives a fast movement of the valve 18 to the open position. This construction provides a slow movement of the modulating valve 18 from its full open to closed position for supplying liquid waste to the incinerator and produces a fast movement of the valve to the open position to reduce the rate of liquid waste flow to the nozzle assembly.

The graph, FIG. 7, illustrates the flow of liquid waste to the nozzle versus the stack temperature in the system of the invention. As shown in the graph, there will be a zero flow of the liquid waste material to the nozzle until the stack temperature reaches approximately 1300° F. At this temperature, the modulating valve 18 operates to gradually increase the flow rate until full flow is achieved at approximately 1500° F. As previously noted, the flow is increased incrementally or in steps, as it changes from 0% to 100%.

At temperatures ranging from 1500° F. to approximately 1700° F., full flow of the nozzle assembly is achieved, and as the stack temperature rises above 1700° F., the flow is reduced until zero flow is achieved at approximately 1900° F. Thus, at the upper set point, which is shown in FIG. 7 to be approximately 1700° F., the feed rate decreases on temperature rise. This occurs when burning liquids with high BTU values which drive up the stack temperature. The lower set point 1500° F., comes into play when feeding liquids with low BTU values, such as water base liquids, which drive down the stack temperature. At the lower set point, the feed rate decreases in temperature drop and the purpose of the low end modulation is to insure that minimum combustion temperatures are maintained in the stack 7 in order to achieve complete burn out in the incinerator thermal reactor. When the stack temperature stays between the upper and lower set points, full liquid feed rate of the nozzle assembly is maintained.

Figure 10:
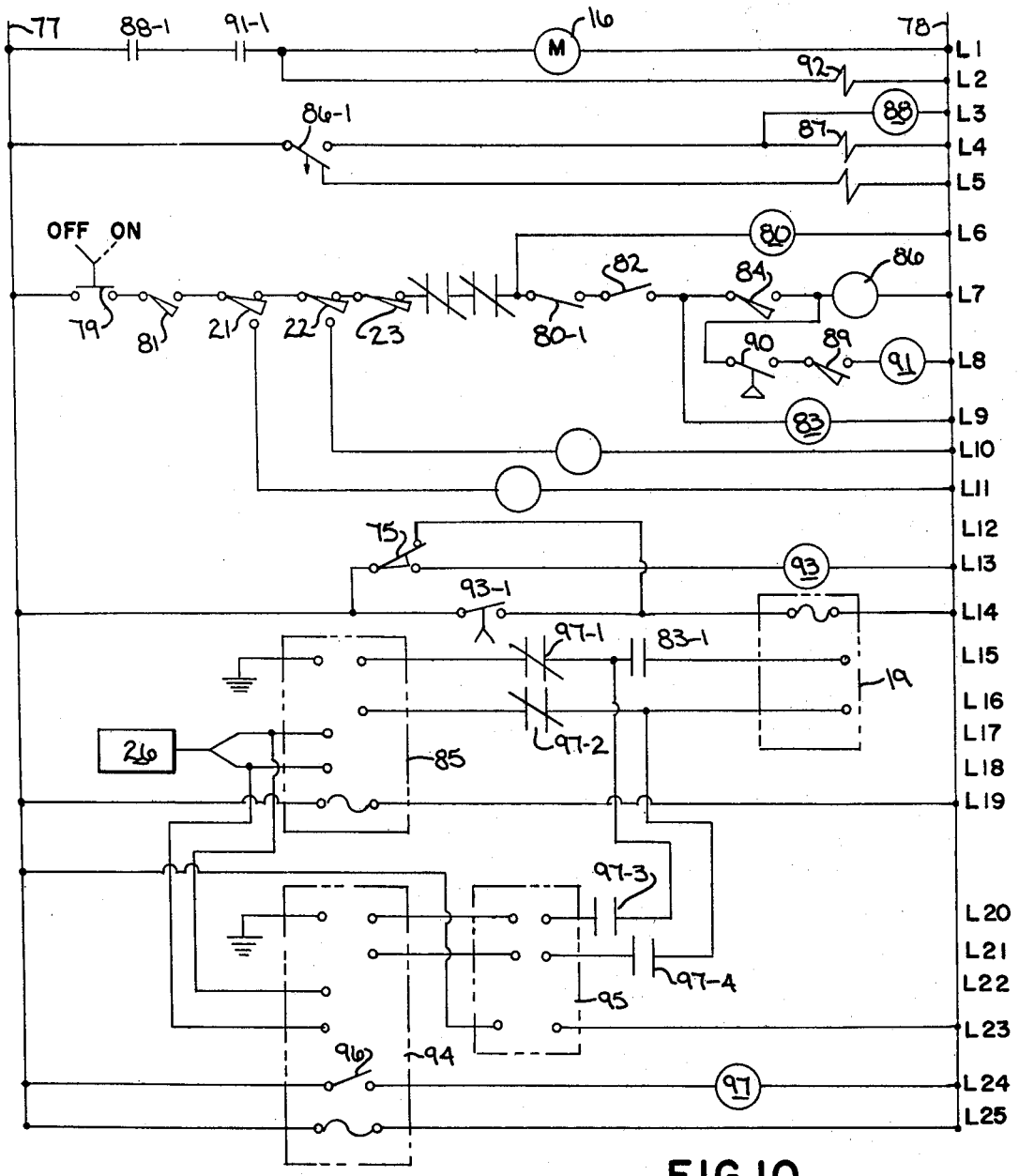
FIG. 10 is a wiring diagram.

The wiring diagraph for the system of the invention is illustrated in FIG. 10. The main power lines are indicated by 77 and 78, and to begin the operation of the automatic system the main "on-off" switch 79 in line L7 is closed and this will energize the relay time delay 80 in line L6, assuming that the switches 81, 21, 22 and 23 are closed. As previously noted, switch 21 is a vacuum switch in flow line 14 and will normally be closed if the vacuum upstream of pump 15 is within the preset limits, while pressure switch 22 will normally be closed if the pressure in line 14 upstream of pump 15 is within the setting. Liquid level switch 23 will be closed if the liquid level in tank 13 is above the level of the sensor switch 23. The switch 81 is associated with feed door on the incinerator and if the door is in the normally closed position, switch 81 will be closed.

Energizing relay 80 will close the switch 80-1 in L7 after a pre-set time delay and if the temperature in the pyrolysis chamber is above 800° F., as sensed by the sensor 24, the switch 82 will be closed. The purpose of the time delay relay 80 is to allow sufficient time for motor 19 to move flow control valve 18 to its open position so that when the system is started, it will start with minimum flow to nozzle assembly 11.

With the switches 80-1 and 82 closed, relay 83 in L9 will be energized to close the contact 83-1 in L15. However, the switch 84 in L7, which is operated by the modulating valve motor 19, will be open until the stack temperature reaches a value of 1300° F. as recorded by the sensor 26.

The sensor 26 is connected by lines L17 and L18 to a high temperature modulating unit 85. Power from lines 77 and 78 is supplied to the modulating unit through L19. The output from the modulating unit is connected through L15 and L16 to the motor 19 and power is supplied from power lines 77 and 78 to the motor through L14. Thus, as the temperature in the stack, as sensed by sensor 26, rises above 1300° F., power will be supplied to the modulating unit 85 and the output from the modulating unit will be transmitted to the motor 19 to rotate the motor output shaft 64 and control shaft 67. Initial rotation of the control shaft 67 will close switch 84 in L7 to energize time delay relay 86 and energization of time delay relay 86 will actuate the switch 86-1 in L4 to supply power to solenoid 87 to thereby supply air to extend the cylinder 28 and move the nozzle tube 35 into the pyrolysis chamber. Actuation of the switch 86-1 also energizes relay 88 in L3 to close the normally open contacts 88-1 in L1. When the nozzle tube 35 is fully extended into the pyrolysis chamber, the switch 89 in L8 will close, and assuming the pressure switch 90 to the air supply is closed, the relay 91 will be energized to close the contacts 91-1 in L1, thereby supplying power to the motor 16 of pump 15. Closing the contacts 91-1 also supplies power to the solenoid 92 in L2 to open the valve in the air supply line and deliver air to the nozzle tube 35 to atomize the liquid waste which is being supplied to the nozzle tube by operation of the pump motor 16.

Relay 86 is an off-delay timing relay. If power is interrupted to relay 86, is will start timing contact 86-1 and when a preset time has expired, contact 86-1 will transfer power from solenoid 87 to solenoid 87-A in L5 which will retracted the nozzle.

As previously described, the switch 75 in L13 is normally open and after the arm 68 on motor shaft 67 rotates through a predetermined arc, the switch 75, is closed thereby energizing the relay 93 in L13 and actuating the timer 93-1 in L14. The timer 93-1 is an "on-off" type which acts to supply power to the motor 16 in increments so that the valve 15 will move slowly from its full open to full closed position.

The temperature sensor 26 in the stack is connected to a low temperature modulating unit 94 through L22 and L23. Power is supplied to the modulating unit 94 through L25.

The output of the low temperature modulating unit 94 is connected to a signal transmitter 95 which acts to invert the signal supplied from low temperature modulating unit 94, and the output from the signal transmitter can be transmitted to the motor 19.

The switch 96 in L14 is set at a temperature of approximately 1600° F., and if the temperature in the stack 7, as measured by sensor 26, is lower than this value, switch 96 will close to energize relay 97 in L24, and thereby open the normally closed contacts 97-1 and 97-2 in L15 and L16 to discontinue the transmission of control signal from high temperature modulating unit 85 to motor 19 and simultaneously close the normally open contacts 97-3 and 97-4 in L20 and 21. With this action, a control signal will then be transmitted through low temperature modulating unit 94 and signal transmitter 95 to the motor 19 to operate the motor such that it closes the control valve on temperature rise. When the stack temperature increases above 1600° F., switch 96 will open to deenergize relay 97 and thereby the control signal is supplied through the high temperature modulator 85 to the motor 19 of the modulating valve to thereby move the valve toward the open position to decrease the flow of liquid waste to the nozzle tube on temperature rise.

When burning high BTU liquids, the liquid flow rate thus will adjust so that the temperature will be maintained at the setpoint With the system of the invention, when the stack temperature reaches the upper set point, control 85 will cause the control valve to move toward its open position and thereby decrease the liquid waste feed rate on continued temperature rise. This action will occur when burning liquids with high BTU values which drive up the stack temperature. On the other hand, when feeding liquids with low energy levels, such as water based liquids, the stack temperature will decrease, and at the lower set point, the feed rate decreases to maintain minimum combustion temperature in the pyrolysis chamber.

As previously noted, if the vacuum and pressure in flow line 14 are not within the preset limits, the respective switches 21 and 22 will open to energize the corresponding relays 98 and 99 in L10 and L11. Energizing relay 98 will open the normally closed contacts 98-1 in L11, while energizing relay 99 will open the contacts 99-1 in L11. Thus, operation of the system will be stopped if the vacuum and pressure conditions are outside the required limits.

Various modes of carrying out the invention are contemplated as being within the scope of the following claims particularly pointing out and distinctly claiming the subject matter which is regarded as the invention.

I claim:

1. A method of incineration, comprising the steps of burning solid waste in a combustion chamber of an incinerator, discharging waste gases of combustion from the combustion chamber through a stack, mounting a liquid supply nozzle in sliding relation with respect to an opening in said incinerator whereby the nozzle can be moved between a retracted position located outside of the combustion chamber and an extended position located within the combustion chamber, measuring the temperature of the gases in the stack, moving the nozzle from the retracted position to the extended position when the stack temperature is at a predetermined elevated value, and introducing liquid waste into the nozzle after the nozzle has been moved to the extended position and spraying said waste from the nozzle into the combustion chamber.

2. The method of claim 1, and including the step of atomizing the liquid waste as it is discharged from the nozzle into the combustion chamber.

3. The method of claim 1, and including the step of moving the nozzle to its retracted position when the temperature of the gases in the stack decrease to below a preset temperature.

4. The method of claim 3, and including the step of closing off the opening in the combustion chamber after the nozzle has been moved to its retracted position.

5. A method of incineration, comprising the steps of burning solid waste in a combustion chamber, discharging waste gases of combustion from the chamber, mounting a nozzle for movement between a retracted position located outside of the combustion chamber and an extended position located within the combustion chamber, sensing the temperature of the waste gases, moving the nozzle from the retracted position to the extended position when the temperature of the waste gases is above a predetermined value, introducing a combustible liquid waste into the nozzle after the nozzle has moved to its extended position and spraying said liquid waste into the combustion chamber, and controlling the flow of liquid waste through said nozzle in response to the temperature of said waste gases to maintain the temperature of the gases within pre-set limits.

6. A method of incineration, comprising the steps of feeding solid waste material to a combustion chamber of an incinerator, burning the solid waste material and discharging the waste gases of combustion from said combustion chamber through a stack, separately supplying liquid waste to the combustion chamber when the stack temperature is at a value above a first elevated temperature, modulating the flow of the liquid waste to the combustion chamber in accordance with variations in the stack temperature between said first temperature and a second temperature higher than said first temperature, providing a substantially uniform flow of liquid waste to the combustion chamber in accordance with variations in the stack temperature between the second temperature and a third temperature higher than said second temperature, and modulating the flow of liquid waste to the combustion chamber in accordance with variations in the stack temperature between said third temperature and a fourth temperature higher than said third temperature.

7. The method of claim 6, and including the steps of causing the flow rate of the liquid waste to increase from zero flow to full flow in a first time period on an increase in the stack temperaure from said first temperature to said second temperature, and causing the flow rate of said liquid waste to decrease from full flow to zero flow in a second time period substantially less than said first time period on a decrease in stack temperature from said second temperature to said first temperature.

8. The method of claim 1, and including the step of discontinuing the supply of liquid waste to said nozzle when the temperature of the gases in the stack fall below an elevated value, and moving said nozzle from the extended position to the retracted position after a predetermined time period following the discontinuance of the supply of said liquid waste to said nozzle.

* * * * *